United States Patent [19]

Love et al.

[11] 4,134,453

[45] Jan. 16, 1979

[54] METHOD AND APPARATUS FOR PERFORATING AND SLOTTING WELL FLOW CONDUCTORS

[75] Inventors: Robert G. Love; Robert Q. Shelton, both of Duncan, Okla.; Joseph B. McCalla, Jr., Corpus Christi, Tex.

[73] Assignee: Halliburton Company, Duncan, Okla.

[21] Appl. No.: 852,887

[22] Filed: Nov. 18, 1977

[51] Int. Cl.[2] ..... E21B 43/114

[52] U.S. Cl. ..... 166/298; 166/55; 299/17

[58] Field of Search ..... 166/77, 242, 298, 55, 166/222; 175/67; 299/17

[56] References Cited

U.S. PATENT DOCUMENTS

| | | | |
|---|---|---|---|
| 2,315,496 | 4/1943 | Boynton | 166/298 X |
| 3,130,786 | 4/1964 | Brown et al. | 166/298 X |
| 3,175,613 | 3/1965 | Hough et al. | 166/298 |
| 3,234,723 | 2/1966 | Brown | 166/242 X |
| 3,313,346 | 4/1967 | Cross | 166/77 X |
| 3,719,230 | 3/1973 | Kemp et al. | 166/242 |
| 3,866,679 | 2/1975 | Laky | 166/77 |

OTHER PUBLICATIONS

Savanick, "Water Jet Perforator for Uranium Leaching Wells", Uranium Mining Technology Conference, University of Nevada, Apr. 1977.

*Primary Examiner*—Stephen J. Novosad
*Assistant Examiner*—George A. Suchfield
*Attorney, Agent, or Firm*—John H. Tregoning; James R. Duzan

[57] ABSTRACT

Apparatus and a method for cutting round perforations and elongated slots in well flow conductors used in solution mining. The apparatus comprises a jet nozzle head for discharging a fluid to cut the perforations and slots, a string of continuous tubing for handling the jet nozzle head in a well bore, a tubing injector or tubing guide, a tubing storage reel having a flow conducting central hub connected with the tubing on the reel for forcing the abrasive fluid into the tubing at the reel, fluid pump and storage means connected with the reel hub, means for mounting the tubing injector above a well, and a wellhead having annular stripper rubber for sealing around the tubing and a side outlet for fluid returns. The method includes the steps of supporting the nozzle head on a first end of the tubing, lowering the nozzle head in a well bore with the tubing injector until the nozzle head is at the desired depth, pumping a fluid through the hub of the storage reel into the tubing and outwardly through the nozzle head until the perforations are cut. For slotting the tubing and nozzle head are reciprocated the distance equal to the length of slots desired. The returns from the nozzle head flow upwardly in the annulus to the wellhead and outwardly through the side outlet.

8 Claims, 3 Drawing Figures

METHOD AND APPARATUS FOR PERFORATING AND SLOTTING WELL FLOW CONDUCTORS

This invention relates to perforating and slotting well flow conductors and more particularly relates to slotting and perforating well flow conductors used in solution mining.

In essentially all types of wells including oil and gas wells, water wells, and wells which are drilled for the purpose of solution mining, it is a well known practice to case the wells by inserting a pipe or flow conductor to the desired depth and cementing the conductor in place by pumping cement downwardly, out of the lower end of the flow conductor, and upwardly around the flow conductor within the wellbore where the cement is allowed to set and securely fix the flow conductor in the wellbore. Various types of materials are used for the flow conductors. For example, in oil and gas wells and water wells in most instances the casing is made up of steel or iron pipe joints. In some wells, however, such as those used in solution mining where minerals such as uranium, sulphur, copper, and nickel are washed or bleached from an earth formation, the well casing may be of a non-metallic type such as formed of a polyvinyl chloride material or glass reinforced thermosetting epoxy resin material. In all these various types of wells in order to carry out the particular process for which the well has been drilled, it is necessary to provide perforations which are generally round or elongated slots through the well casing to permit communication between the well bore and the earth formation around the cemented well casing so that flow may occur either from the formation into the wellbore through the casing or from the wellbore outwardly through the casing into the formation. In the case of solution mining, usually one or more central production wells are located within a ring of injection wells, thus both the injection and producing wells must be perforated or slotted in order to flow the solutions between the wells for removal of the desired minerals. One type of available apparatus and method which has been used to perforate and slot well casing and other well flow conductors has usually involved running and pulling of an operating string made up of a plurality of pipe sections connected together end to end and run into the well and pulled by a means of a rig or derrick mounted over the well adapted to manipulate the string by sequentially adding or removing the pipe sections one at a time. This is a time-consuming and expensive process which involves individually connecting together adjacent pipe section ends during both running and pulling each time a pipe section is handled.

Other types of apparatus and methods which have been used to perforate well casing and other well flow conductors have involved using explosive charges. However, while the use of explosive charges to perforate well casing and other flow conductors is a convenient well completion means, the jets of hot gaseous material emanating from the explosive charges upon detonation tend to damage the surrounding wellbore formation. In this connection, if the well casing is of non-metallic type, such as a polyvinyl chloride material or a glass fiber reinforced thermosetting epoxy resin material, the jets of hot gaseous material emanating from the explosive charges, while temporarily perforating the well casing, cause the material surrounding the perforations to be heated sufficiently to flow into the perforations subsequent to their formation thereby causing the well casing to become impervious to the flow of formation fluids into the wellbore. Also in the case of a glass fiber reinforced thermosetting epoxy resin material type well casing, when an explosive charge is used to perforate the well casing, the well casing is usually shattered and is subject to delamination from the effects of the jet of hot gaseous materials emanating from the explosive charge.

In accordance with the present invention there are provided apparatus and a method for perforating and slotting well flow conductors. The preferred apparatus includes a string of continuous tubing of a length sufficient to reach a depth in the well at which the perforations or slots are desired, a jet nozzle head connected with a first free end of the continuous tubing, a storage reel for the continuous tubing having a fluid conducting central hub connected with the second end of the continuous tubing on the storage reel, pump and fluid storage apparatus connected with the hub of the storage reel for pumping fluid through the storage reel hub into the continuous tubing, a tubing injector mounted above the well in which the method is to be carried out for running and pulling the continuous tubing and jet nozzle head, and a well head on the well flow conductor provided with an annular stripper rubber member for sealing around the continuous tubing as it is run and pulled, and a side outlet into the wellhead below the stripper rubber for fluid returns from the wellhead. The method is carried out by connecting the jet nozzle supported on the continuous tubing from the reel through the tubing injector and the wellhead into the well flow conductor. The tubing is lowered by means of the injector until the jet nozzle is at the depth in the well at which the perforations or slots are to be formed. A fluid is then pumped through the storage reel hub into the continuous tubing and outwardly into the wellbore through the jet nozzle head. The discharging jets cut the desired perforations in the flow conductor in the wellbore with the fluid returns passing upwardly in the annulus of the wellbore around the continuous tubing and outwardly through the side outlet of the wellhead below the stripper rubber. If slots ar desired in the flow conductor, the tubing injector is operated to reciprocate the tubing and the jet nozzle head a distance equal to the length of the slots desired until the slots are cut. The continuous tubing and jet nozzle head are then removed from the wellbore by means of the tubing injector.

The foregoing advantages and the preferred embodiments of the invention will be better understood from the following specification taken in conjunction with the accompanying drawings wherein.

Figure 1:
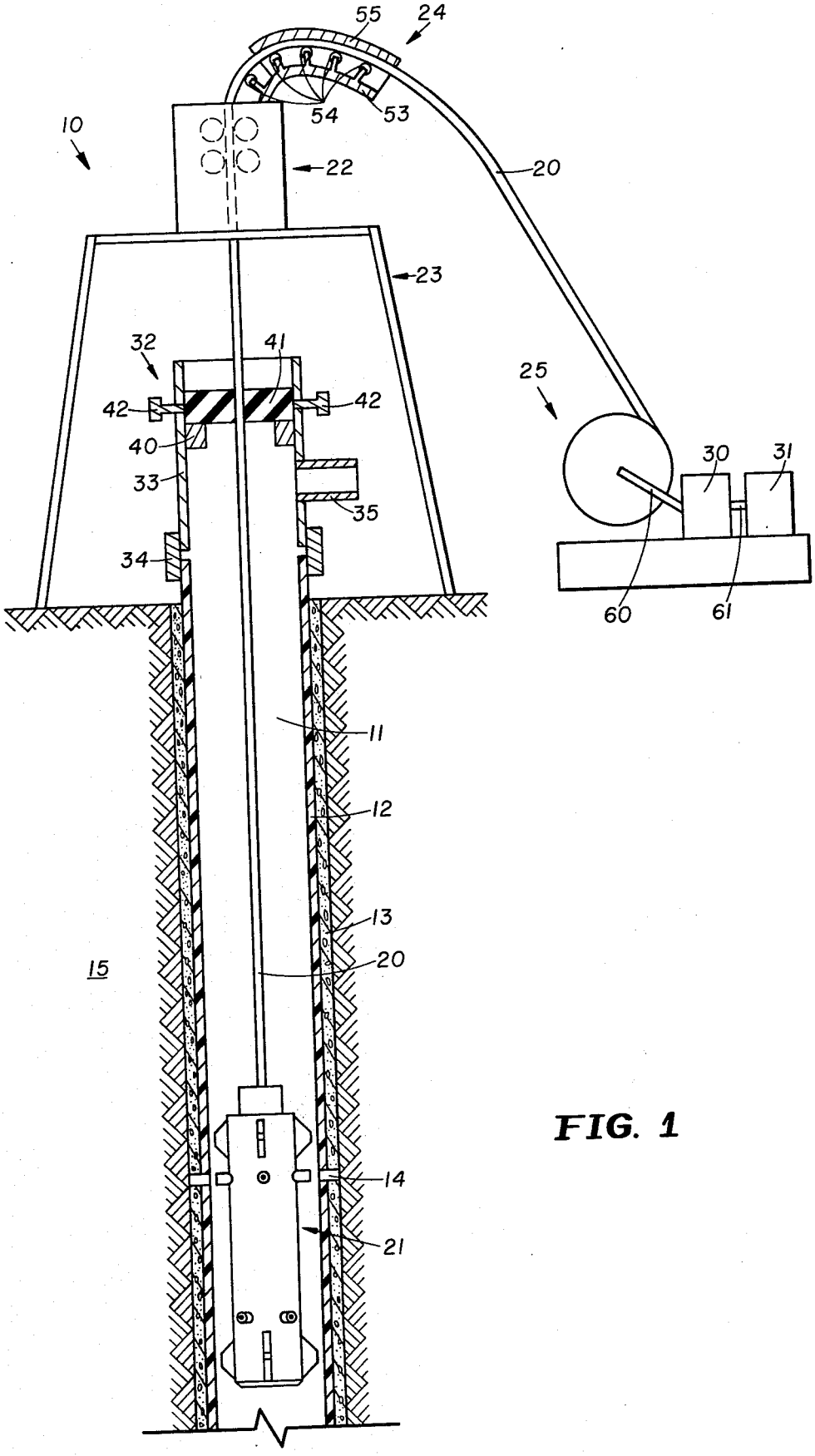
FIG. 1 is a side view in elevation and section in schematic form of a cased wellbore in which perforations are cut in accordance with the invention, the continuous tubing and jet nozzle head, the wellhead, the continuous tubing injector, and the storage reel and fluid pump and fluid storage tank employed in carrying out the method of the invention.

Referring to FIG. 1, the invention is shown in its preferred embodiment. A continuous tubing type jet perforating and slotting system 10 is shown supported over a well 11 which is provided with a well casing 12 which has been cemented in the wellbore at 13. The apparatus of the invention is employed to form perforations 14 in the well casing 12 to communicate from the wellbore with the earth formations 15 around the wellbore.

The perforating and slotting system 10 includes a string of continuous tubing 20 supporting a jet nozzle head 21, a continuous tubing injector 22 mounted on a platform 23, a continuous tubing guide assembly 24 operable with the injector 22, a continuous tubing storage reel 25, a pump 30 connected with the storage reel, and a fluid storage tank 31 connected with the pump.

The continuous tubing used in the invention is preferably a form of flexible tubing which may be made of a material such as steel and which is constructed to be stored on a reel and is adapted to be wound onto and from the reel without exceeding the acceptable stress standards for the tubing. Such tubing is available in sizes ranging from one-half inch to 1 inch outside diameter. The size selected must be large enough to permit the fluid to be injected without a pressure drop sufficient to affect the cutting ability of the jet streams emitted from the jet nozzle head.

The continuous tubing is operated through a wellhead 32 mounted on the wall casing 12 for sealing around the continuous tubing and directing the flow of the fluid returns as discussed in detail hereinafter.

The wellhead 32 includes a pipe section 33 connectable by a coupling 34 with the upper end of the conductor 12. An outlet 35 is secured with the pipe section 33 for the discharge of fluid returns passing up the flow conductor in the annulus around the continuous tubing string. Above the outlet 35 a seat flange 40 is formed in the pipe section to support an annular stripper rubber member 41 which is held in place and forced radially inwardly around the continuous tubing by a plurality of circumferentially spaced set screws or bolts 42 which typically may comprise six or more such set screws. The outlet 35 may simply discharge to the ground around the wellhead or may be connected back into the tank 31 for recirculation of the fluid used to form the perforations and slots in the well casing.

Figure 2:
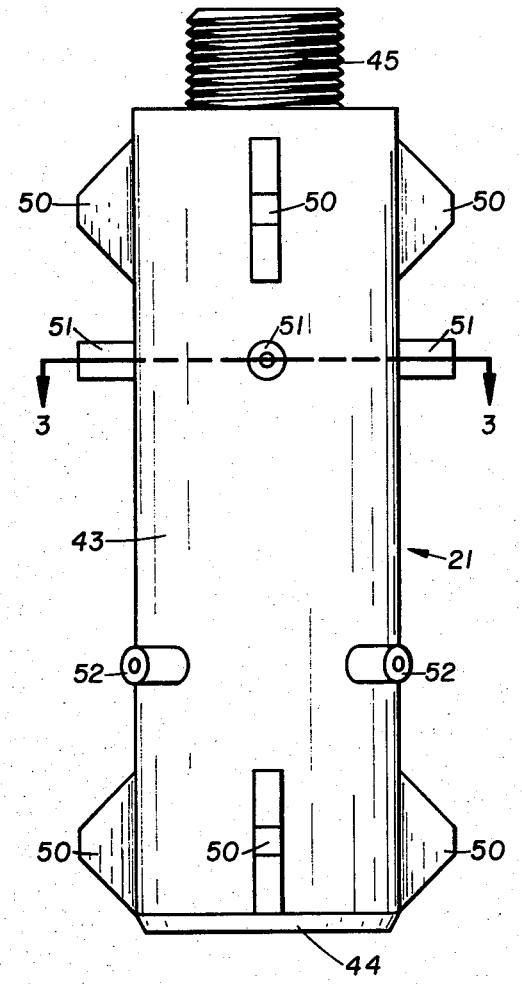
FIG. 2 is an enlarged side view in elevation of the jet nozzle head employed in the invention.
Figure 3:
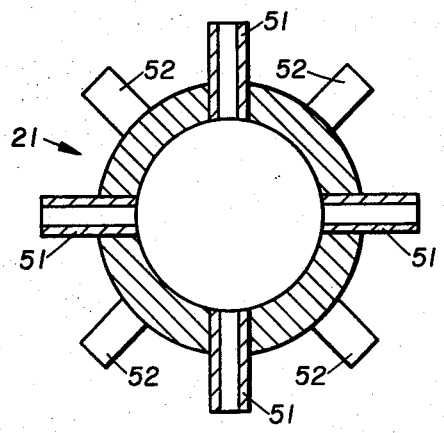
FIG. 3 is a view in section along the line 3—3 of the nozzle head shown in FIG. 2.

The jet nozzle head 21 includes a tubular body 43 closed at a lower end by a plate 44 and secured at the upper end with a coupling section 45 used to connect the nozzle head with the free end of the continuous tubing 20. The upper and lower ends of the body 43 are each provided with radially outwardly extending centralizer ribs 50 circumferentially spaced at 90° intervals around the upper and lower ends of the nozzle head to function as centralizers for keeping the nozzle head centrally located within the well casing as it is lowered and retrieved and operated within the casing. A set of upper jet nozzles 51 are secured around the body 43 at 90° intervals opening into the body below the upper centralizer set. Similarly a set of identical lower jet nozzles 52 are secured through the nozzle head body on 90° circumferential spacing, each of the lower nozzles being located equidistant between the adjacent pair of upper nozzles 51 as evident in both FIG. 2 and FIG. 3. The particular configuration of jet nozzle head illustrated will provide a total of eight round perforations in the well casing comprising an upper set of four at 90° intervals and a lower set of four at 90° intervals spaced at 45° intervals between the upper perforations. If slots are desired, the nozzle head will provide eight longitudinal slots of any desired length spaced at 45° intervals around the well casing. The jet nozzles 51 and 52 are made of a suitable abrasive resistant material which will permit the use of either a non-abrasive fluid or an abrasive fluid to be pumped through the nozzles to form the perforations or slots in the well casing and preferably have diameters ranging from 0.03125 inches to 0.093 inches to form a perforation or slot which is sufficiently large enough to allow the ingress of formation fluids but small enough to resist the ingress of formation materials.

The continuous tubing injector 22 is one of a number of available apparatus which straightens and drives the continuous tubing downwardly through the wellhead into the wellbore and pulls the tubing from the wellbore. One such available unit is known as the OTIS CONREEL CONTINUOUS TUBING UNIT illustrated and described in Otis Engineering Corporation Catalog Sheet 5117A published October 1976 which also illustrates the tubing guide assembly 24. Another unit which may be used to insert and pull the continuous tubing is illustrated in U.S. Pat. No. 3,182,877 issued May 11, 1965 to D. T. Slator, et al.

The guide assembly 24 has a curved member 53 secured with the injector 22 supporting a plurality of guide rollers 54 aligned along a suitable arc which will permit the required change of direction in the continuous tubing as it moves between the reel 25 and the injector 20. An outer guide rail 55 is secured with the member 53 formed along an arc parallel with the member 53 and the rollers 54 to hold the continuous tubing against the rollers as it moves between the reel and the injector. The guide rail assembly is a part of the OTIS CONREEL UNIT previously referred to.

The storage reel 25 for the continuous tubing is a suitable available reel which also is a part of the OTIS CONREEL UNIT as previously identified having a central hub connected with the second end of the continuous tubing 20 and providing a fluid connection with the second end of the tubing leading to a conduit 60 running from the reel hub to the pump 30. The pump is connected by conduit 61 with the storage tank 31 so that fluid in the storage tank may be discharged from the tank into the second end of the continuous tubing string 20 through the reel hub as the tubing is unwound from the reel.

For the operation of the system 10 to provide perforations or slots in the well casing 12, the tubing injector 22 is supported on the platform 23 over the wellbore 11. The continuous tubing 20 on the storage reel 25 is manipulated from the storage reel through the guide assembly 24 and the injector 22 until the free end of the tubing extends downwardly below the platform from the ejector. The free end of the continuous tubing is inserted through the stripper rubber 41 within the wellhead 32, with the wellhead off of the upper end of the well casing 12. The jet nozzle head 21 is then connected with the free end of the continuous tubing and the rjet nozzle head 21 is placed downwardly into the upper end of the well casing 12. The well head 32 is then mounted on the upper end of the well casing by means of the coupling 34. The sew screws 42 are adjusted to tighten the stripper rubber 41 around the continuous tubing to prevent any leakage of the cutting fluids through the wellhead along the tubing.

The injector 22 is then operated to pull the continuous tubing 20 from the reel 25 through the guide assembly 24 and push the tubing through the wellhead into the wellbore until the jet nozzle head 21 is at the depth in the wellbore at which the perforations 14 are desired in the well casing 12. As the jet nozzle head 21 is lowered in the well casing and when the jet nozzle head reaches the desired depth in the casing, the guide fins 50 moving along the inner wall surface of the well casing 12 keeps the jet nozzle head at a central location along the axis of the well casing.

A suitable fluid is prepared and placed in the storage tank 31. The fluid may comprise either water or sand-mixed with water in a concentration range of about one-eighth to 1 pound of sand per gallon of water. Depending upon the diameter of the nozzles 51 and 52 and the type of material to be perforated, the sand may range in size from 40–60 mesh size to 200 mesh size with 100 mesh size sand generally being the most satisfactory. A gel comprising a thixotropic solution such as water, bentonite, and sand may be used so the sand will remain suspended when flow ceases, and will flow when pumping resumes.

The fluid is pumped from the tank 31 into the hub of the reel 25 through the conduit 60. The fluid flows through the reel hub into the second end of the continuous tubing 20 which is secured with the hub on the reel. The fluid is pumped through the continuous tubing downwardly into the wellbore to the jet nozzle head 21. The fluid is forced outwardly through the nozzles 51 and 52 impinging upon the inner wall surface of the well casing 12. The fluid within the annulus in the well casing around the head 21 and the continuous tubing 20 flows upwardly along the wellbore to the wellhead 32 from which the returning fluids flow outwardly through the outlet 35 below the stripper rubber 41 which prevents any leakage from the wellhead along the continuous tubing. The fluids either are discharged to some disposal facilities, onto the ground, or back to the storage tank 31. The circulation of the fluid through the jet nozzle head 21 is continued until the abrasive action of the fluid cuts through the well casing 12 and the surrounding sheath of cement 13 into the earth formation 15.

The jetting action is continued until the desired number of perforations are cut through the well casing 12 and the cement sheath 13. The length of time required to cut the perforations will vary depending upon the operating conditions and the materials of which the well casing is made and the materials included in the abrasive fluid. Previously conducted surface tests on a casing section provide a guide as to the maximum time required to accomplish the necessary cutting. Under some conditions an indication of the cutting of the perforations may be obtained by a change in the volume of the returns through the outlet 35. Another method of determining when the casing is properly cut is the lowering of a camera, though this does require pulling the tubing 20 and jet nozzle head 21.

Longitudinal slots may be cut in the well casing 12 and the cement sheath 13 by reciprocating the jet nozzle head 21 using the tubing injector 22 to move the continuous tubing and the jet nozzle head upwardly and downwardly until slots of the desired length are cut. During reciprocation of the jet nozzle head 21, each of the jet nozzles 51 and 52 will cut a longitudinal slot in the well casing.

When the desired perforations or slots have been cut in the well casing the continuous tubing 20 and jet nozzle head 21 may be removed from the well. The tubing injector 22 is used to pull the tubing 20 and jet nozzle head 21 upwardly until the jet nozzle head 21 is pulled into the wellhead 32. The coupling 34 is then manipulated to release the pipe section 33 from the upper end of the well casing. The wellhead 32 along with the jet nozzle head 21 are lifted from the upper end of the well casing 12 and the jet nozzle head 21 is then disengaged from the end of the continuous tubing 20. The tubing injector 22 and the reel 25 are then operated to fully withdraw the continuous tubing 20 from the well. The well may then be equipped with such other wellhead facilities as are required for the particular procedure to be carried out in the well.

When perforating polyvinyl chloride material well casing, it is preferable that the fluid used be only water which is ejected at a pressure of 5,000 psi to 15,000 psi, preferably 8,000 psi to 10,000 psi, to yield satisfactory results. Furthermore, the nozzle jet head 21 should be within one to 20 jet nozzle diameters of the well casing to produce holes sufficiently small in diameter in the casing to exclude formation materials from flowing into the well casing during formation production.

In the case where glass fiber reinforced thermosetting epoxy resin material well casing is to be perforated, it is desirable to use an abrasive fluid supplied at a pressure less than 4,000 psi to yield satisfactory results. In this instance, it is desirable to maintain the nozzle jet head 21 within two to twenty, preferably two or three, jet nozzle diameters of the well casing to produce holes sufficiently small in diameter in the casing to exclude formation materials from flowing into the well casing during formation production. If the jet nozzle head 21 is within a distance of less than two jet nozzle diameters of the well casing, excessive nozzle jet wear occurs on the exterior surface of the nozzle jets due to the abrasive fluid splashing on the nozzle jet exterior surfaces. If the nozzle jet head 21 is more than twenty nozzle jet diameters from the well casing, the perforations made by the nozzle jet head 21 are large enough to allow formation materials to flow into the wellbore. In this connection, if glass fiber reinforced thermosetting epoxy resin material well casing is perforated using water only as the fluid, the well casing will delaminate and break rather than be cleanly perforated.

It will now be seen that a new and improved method and apparatus for using continuous tubing to provide perforations or longitudinal slots in a well casing has been described and illustrated. The use of the continuous tubing allows the procedure to be carried out in one continuous sequence of steps without the necessity for the more expensive and time consuming procedure of using pipe sections which are connected and disconnected with each other during the running and pulling of the tubing string and jet nozzle head 21. However, if desired, conventional pipe sections are a continuous string of reinforced rubber hose may be used as the tubing string. If pipe sections or a continuous string of reinforced rubber hose is used rather than the continuous steel tubing, the OTIS CONREEL CONTINUOUS TUBING UNIT must be replaced with conventional manifolding equipment including a tubing guide for insertion of the tubing into the wellhead and, in the case of a continuous string of reinforced rubber hose, the use of a storage reel is optional.

It would be understood that these and other modifications can be made within the scope of the invention and the following claims will be understood to include such modifications as do not depart from the broad scope of the invention.

What is claimed is:

1. A method of cutting openings in a non-metallic flow conductor secured in a wellbore in a solution mining operation comprising the steps of:

supporting a jet nozzle head on one end of a continuous string of steel tubing;

running said steel tubing and said jet nozzle head into said non-metallic flow conductor until said nozzle head is at the depth at which the openings are desired in said non-metallic flow conductor;

providing said jet nozzle head with a plurality of discharge jet nozzles arranged in a plurality of vertically spaced arrays, each array having a plurality of said jet nozzles arranged in a common horizontal plane, each said jet nozzle having a diameter in the range of 0.03125 inches to 0.093 inches and arranged in a predetermined configuration such that each said jet nozzle is positioned 90° from the adjacent said jet nozzles in the same horizontal nozzle array while being positioned 45° from the adjacent said jet nozzles in other vertically spaced nozzle arrays, said jet nozzle head including centralizer means on the exterior thereof to center said jet nozzle head in said non-metallic flow conductor in said wellbore;

positioning said jet nozzle of said jet nozzle head within one to 20 nozzle jet diameters of said non-metallic flow conductor;

pumping a fluid through said steel tubing and out said jet nozzle head until openings are cut in said non-metallic flow conductor by said fluid;

sealing around said tubing at a quickly releasable wellhead including rubber gasket means on said non-metallic flow conductor and retaining said fluid in the annulus within said non-metallic flow conductor around said steel tubing above said jet nozzle head and out through a side outlet in said wellhead below the point of sealing around said steel tubing; and removing said steel tubing and said jet nozzle head from said well.

2. The method of claim 1 further comprising the step of:

reciprocating said tubing and said jet nozzle head to cut longitudinal slots in said flow conductor by said fluid.

3. The method of claim 1 wherein said fluid is sand mixed with a liquid carrier.

4. The method of claim 3 wherein said liquid carrier is a thixotropic solution.

5. The method of claim 1 further comprising the step of:

positioning said nozzle jets of said jet nozzle head within two to three nozzle jet diameters of said flow conductor.

6. The method of claim 1 wherein said flow conductor is a polyvinyl chloride type material flow conductor.

7. The method of claim 1 wherein said flow conductor is of a glass fiber reinforced thermosetting epoxy resin material type flow conductor.

8. A system for cutting holes in a non-metallic flow conductor in a wellbore in a solution mining operation comprising:

a jet nozzle head having a plurality of jet nozzles arranged in a plurality of vertically spaced arrays, each array having a plurality of said jet nozzle arranged in a common horizontal plane, each jet nozzle having a diameter in the range of 0.03125 inches to 0.093 inches and arranged in a predetermined configuration such that each said jet nozzle is positioned 90° from the adjacent said jet nozzles in the same horizontal nozzle array while being positioned 45° from the adjacent said jet nozzles in other vertically spaced nozzle arrays, to direct jets of fluid at said non-metallic flow conductor in said wellbore for cutting said holes in said non-metallic flow conductor, said jet nozzle head including centralizer means on the exterior thereof to center said jet nozzle head in said non-metallic flow conductor;

a string of continuous steel tubing connected at a first end with said jet nozzle head;

a storage reel having a fluid conducting hub connected with the opposite second end of said string of continuous steel tubing for storing said string of continuous steel tubing and conducting fluid into said second end of said string of continuous steel tubing s said string of continuous steel tubing is moved in said wellbore and said reel is rotated to pay out and take up said string of continuous steel tubing on said reel;

fluid pump means connected with said hub for pumping a fluid to said hub of said reel;

a continuous tubing injector supported above said well including a tubing guide assembly for guiding said continuous steel tubing between said injector and said storage reel; and a quickly releasable wellhead connectable on said non-metallic conductor including rubber gasket means for sealing around said string of continuous steel tubing is run into and pulled from said non-metallic flow conductor.

* * * * *